US006371401B1

(12) United States Patent
Ketterer

(10) Patent No.: US 6,371,401 B1
(45) Date of Patent: Apr. 16, 2002

(54) APPARATUS FOR REMOVING A FLOOR COVERING

(75) Inventor: Max Ketterer, Titise-Neustadt (DE)

(73) Assignee: Janser GmbH (DE)

( * ) Notice: Subject to any disclaimer, the term of this patent is extended or adjusted under 35 U.S.C. 154(b) by 0 days.

(21) Appl. No.: 09/562,697

(22) Filed: Apr. 28, 2000

(30) Foreign Application Priority Data

Apr. 29, 1999 (DE) ..... 299 07 586 U

(51) Int. Cl.[7] ..... B65H 19/28

(52) U.S. Cl. ..... 242/532.4; 242/532.5; 242/533.8; 242/546; 242/557; 156/584

(58) Field of Search ..... 242/532.4, 532.5, 242/532.6, 533.8, 539, 546, 918, 919, 557; 156/584; 254/203, 219, 220

(56) References Cited

U.S. PATENT DOCUMENTS 1,346,356 A * 7/1920 Wenderhold ..... 242/532.4
1,815,333 A * 7/1931 Shampay ..... 242/532.4
3,273,171 A * 9/1966 Lamb ..... 242/919
3,403,870 A * 10/1968 Garaboux ..... 242/919
4,281,802 A * 8/1981 Burley ..... 242/919
4,324,370 A * 4/1982 Guard et al. ..... 242/919
4,407,027 A * 10/1983 Colon ..... 242/919
4,632,329 A * 12/1986 Burley ..... 242/919
6,004,426 A * 12/1999 Johnson ..... 156/584
6,027,066 A * 2/2000 Street ..... 242/546
6,199,616 B1 * 3/2001 Gillespie ..... 156/584

* cited by examiner

*Primary Examiner*—John M. Jillions
(74) *Attorney, Agent, or Firm*—R W Becker & Associates; R. W. Becker

(57) ABSTRACT

An apparatus for removing a floor covering is provided. The apparatus has a casing, and a drive therefore that is disposed in the casing. A fastening device, for the floor covering, is disposed on the outer surface of the casing. A support structure, for the casing, is disposed at at least one end portion thereof.

12 Claims, 1 Drawing Sheet

APPARATUS FOR REMOVING A FLOOR COVERING

BACKGROUND OF THE INVENTION

The present invention relates to an apparatus for removing a floor covering, whereby a drivable frame or casing is provided which on its surface area has a fastening apparatus for the floor covering and at its side region has a support structure for the frame.

A known apparatus is a machine for loosening wall-to-wall carpet that has been glued to the sub-floor. Although in the past most carpeting was used with a foam backing that was easy to loosen from the sub-floor, currently primarily needle-felting floor coverings, nodular yarn carpets, or double-backed carpeting are used, and these are glued securely to the sub-floor. The known machine was developed for loosening floor coverings that have been thus securely glued. On its front side, the machine has chopping blades that engage under the carpeting and cut the carpeting from the sub-floor with forward cutting movements. The known machine has a limited operating width of a maximum of 35 cm and is very heavy, i.e. 50 kg to 130 kg. This machine is thus disadvantageously difficult to handle and removing the carpeting is extremely time-consuming since it is only possible to remove small areas of carpeting at a time due to the limited operating width and limited operating feed of the machine.

Another apparatus for removing linoleum is known from U.S. Pat. No. 2,655,976. The known device has a frame with a fastening device, whereby the linoleum is wound onto the frame as it is removed.

An apparatus of the type cited in the foregoing is known from DE 198 10 010 A1. The device removes the floor covering in strips in that it winds the carpet that has been cut into strips onto the frame. This known device is disadvantageously difficult to handle.

The object of the invention is thus to further develop the known apparatus such that it is possible to remove the carpeting rapidly while also having an apparatus with a compact structure that is easy to handle.

BRIEF DESCRIPTION OF THE DRAWING

This object, and other objects and advantages of the present invention, will appear more clearly from the following specification in conjunction with the accompanying schematic drawing, in which.

SUMMARY OF THE INVENTION

Figure 1:
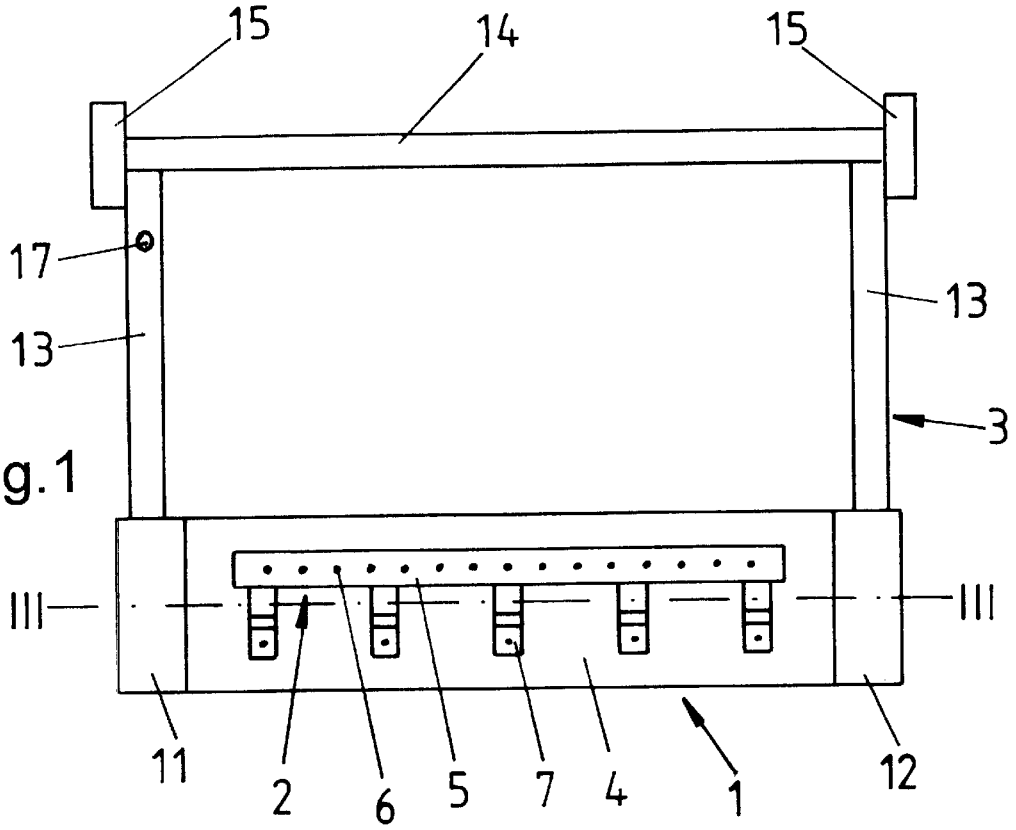
FIG. 1 is a top-view of the apparatus in accordance with the invention.
Figure 2:
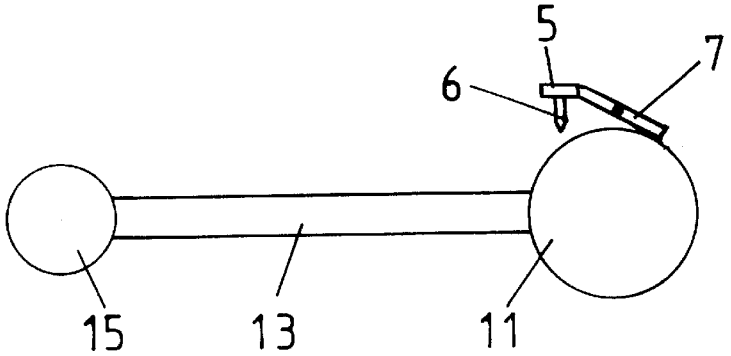
FIG. 2 is a side elevation in accordance with FIG. 1.
Figure 3:
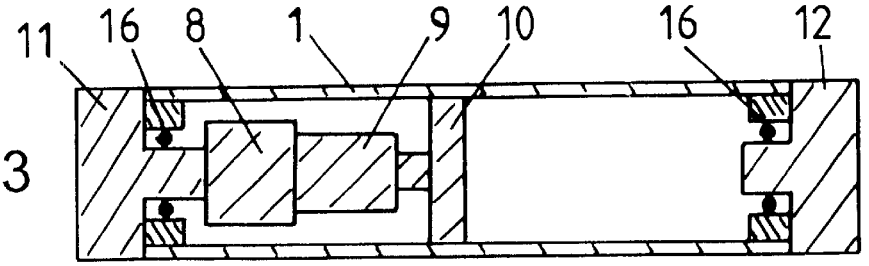
FIG. 3 is a cross-section along the line III—III in FIG. 1.

The apparatus of the present invention for removing a floor covering is characterized primarily in that a drive means for the frame or casing is disposed within such casing.

The arrangement of the drive means in the frame reduces the number of parts located on the exterior, thus facilitating a compact structure. This compact structure makes it possible for the apparatus in accordance with the invention also to be easily employed directly in corner areas between wall and floor. Furthermore, the drive inside the frame is protected from damage.

The frame is on the floor covering when the apparatus in accordance with the invention is operating. The carpeting is fastened to the fastening device and then the frame is driven. This also causes the fastening device arranged on the surface to rotate and wind the floor covering onto the frame, the floor covering being removed from the sub-floor.

The rotational movement of the frame, in addition to winding up the carpeting, also causes the apparatus to move forward so that the apparatus in accordance with the invention rolls over the floor covering when in operation and is always located over the area of the carpeting to be wound up. This facilitates rapid removal of the floor covering. In particular, nodular yarn carpets or needle-felt floor coverings, which are very securely glued to the sub-floor, can be removed cleanly and rapidly with the apparatus in accordance with the invention. However, other coverings, such as PVC coverings or linoleum, can also be removed with the apparatus in accordance with the invention.

Any type of fastening can be used for the fastening device that is on the frame and is provided for the floor covering. For instance, the frame itself can be equipped with mandrels that project outward radially on which the floor covering is secured. It is also possible to provide a slot in the frame in which slot the floor covering is clamped. It would also be possible to have pincer-like apparatus that are arranged on the surface area of the frame. For secure fastening of the floor covering to the frame, a preferred embodiment of the invention provides that the fastening device constitutes a clamping apparatus or a securing apparatus.

Another preferred embodiment of the invention provides that the fastening device has a crossbar on which a plurality of projections are arranged for securing the floor covering. The projections can be mandrels, knobs, nails, or claws. By arranging a plurality of projections adjacent to each other, the floor covering is grasped at relatively short physical intervals and simultaneously wound onto the frame. Another embodiment of the invention provides that the crossbar extends approximately across the width of the frame so that the operating width of the frame is fully utilized.

The crossbar can be fixedly mounted on the frame. For simpler handling when attaching the floor covering to the fastening device, another variant of the invention provides that the crossbar is movably arranged on the frame. This means that the crossbar can be flipped upward away from the frame. Then the floor covering is secured on the projections that are directed toward the frame and the crossbar is lowered, i.e. flipped down toward the frame. For the movable arrangement, the crossbar, in particular a flat bar of iron, is advantageously joined to the frame by means of hinges.

It is useful that the drive has a direct current motor, a gear, in particular a planetary gear, and a driving pulley connected thereto, whereby the driving pulley, arranged inside the frame, is joined to the frame.

The support structure, which is arranged to the side of the frame, can merely be affixed to one side of the frame as a single support arm. However, the support structure advantageously constitutes a U-shaped configuration, whereby when the apparatus is operating it runs on a uniform, straight path along the floor covering. Furthermore, the configuration prevents the apparatus from tipping over if it is leaned against a wall.

A further preferred embodiment of the invention provides that the support structure is hollow inside and receives the lines for the drive. This means that no interfering lines are attached outside the apparatus that could inadvertently become wound up in the floor covering. Since the apparatus in accordance with the invention is very compact and has few parts, its weight is advantageously less than 25 kg and the frame can be up to 2 meters in width. The frame could even be wider depending on requirements. Also, the risk of injury when operating the apparatus is substantially reduced since one design of the invention provides that the frame moves at approximately 13 revolutions per minute. This is a significant advantage over the very rapid blade movement in the known machine, which has a much higher risk of injury.

Further features of the invention will be described in detail subsequently.

DESCRIPTION OF THE PREFERRED EMBODIMENTS

Referring now to the drawing in detail, the apparatus has a frame 1, a fastening device 2, and a support structure 3. The frame or casing 1 comprises a pipe made of aluminum that is about 10 cm in diameter and is about 1 meter wide. The fastening device 2 is arranged on an external surface area 4 of the frame 1. The fastening device 2 for the floor covering comprises a crossbar 5 that extends approximately across the width of the frame 1. Arranged on the crossbar 5 is a plurality of projections 6, in particular mandrels, the tips of which are disposed toward the surface area 4. The crossbar 5 is movably attached to the frame by means of a total of five hinges 7. For securing the floor covering, the crossbar 5 is flipped up away from the surface area 4. Then the floor covering is attached to the projections 6 and the crossbar 5 is lowered back toward the surface of the frame 1. A direct current motor 8 is provided for driving the frame 1; it is arranged inside the frame 1. The direct current motor 8 is connected to a driving pulley or disk 10 by means of a gear 9, in particular a planetary gear. The gear 9 and the driving pulley 10 are also arranged inside the frame 1, whereby the driving pulley 10 is joined to the frame 1 by means of screws that can be screwed onto the surface area 4. The direct current motor 8 is attached to a lateral disk 11 that covers one side of the frame 1. A second lateral disk 12 covers the second side of the frame. Each of the two lateral disks 11, 12 is connected to a longitudinal bar 13 of the support structure 3. The support structure 3 furthermore has a crossarm 14 that connects the two longitudinal bars 13 to each other so that the support structure 3 overall constitutes a U-shaped configuration. Wheels 15 are affixed to each end of the crossarm 14. A ball bearing 16 is provided inside of each of the two lateral disks 11, 12 for bearing the driven frame 1. One of the two longitudinal bars 13 is hollow inside and has a connection opening 17 for the electrical lines for the direct current motor 8.

The lines run inside the longitudinal bar 13 to the lateral disk 11 and further to the direct current motor 8. The direct current motor 8 is operated by means of a 60-Volt transformer, has torque of 240 to 600 Ncm, and during operation moves at about 13 revolutions per minute. The weight of the apparatus in accordance with the invention is about 20 kg for a frame width of 1 m.

When operating the apparatus in accordance with the invention, the floor covering to be removed is first cut into strips using a blade. The width of the strips is somewhat less than the width of the frame 1. Then in the area near the wall, approximately 10 cm of the floor covering are loosened manually and secured on the fastening device 2. The frame 1 is on the floor covering in a corner region between floor and wall and the support structure 3 is disposed vertically upward with its wheels 15 resting against the wall. When the floor covering has been secured, the direct current motor 8 is turned on and the frame 1 begins to rotate, the floor covering being wound onto the frame 1. The rotational movement of the frame 1 simultaneously causes it to roll over the floor covering along the previously cut strips, the support structure 3 moving by means of the wheels 15 along the wall in the direction of the floor until the wheels 15 rest on the floor and continue to roll thereupon. The support structure 3 prevents the direct current motor itself from revolving during operation. The frame 1 now rolls to an opposing wall, pulling off the cut strip of floor covering. As soon as the frame 1 has reached the opposing wall, reverse travel is switched on and the frame 1 rolls back, thereby unwinding the floor covering that has been removed. Once it reaches the wall where it began its travel, the floor covering has been completely unwound from the frame 1 and can be removed manually. The apparatus is now offset, e.g. by one meter and thus moved to the next strip of floor covering and the process starts over from the beginning. A floor covering can be removed rapidly and simply in a very short period of time with the apparatus in accordance with the invention. It takes about one hour to remove from 80 to 100 $m^2$ floor covering using the apparatus. In addition, the apparatus in accordance with the invention operates with practically no noise or dust since the old residual adhesive is pulled up, as well.

The specification incorporates by reference the disclosure of German priority document 299 07 586.9 filed Apr. 29, 1999.

The present invention is, of course, in no way restricted to the specific disclosure of the specification and drawings, but also encompasses any modifications within the scope of the appended claims.

What I claim is:

1. An apparatus for removing a floor covering, comprising:

a casing (1);

a drive means (8) for said casing (1) disposed in said casing;

a fastening device (2) for said floor covering disposed on an outer surface (4) of said casing (1); and a support structure (3) for said casing (1) disposed at at least one end portion of said casing, said support structure (3) having two longitudinal bars (13) and a crossarm (14) connecting said two longitudinal bars (13) to one another, whereby said support structure (3) has a generally U-shaped configuration.

2. An apparatus according to claim 1, wherein said fastening device is a clamping or securing device.

3. An apparatus according to claim 1, wherein said fastening device has a crossbar on which are disposed a plurality of projections for the securement of a floor covering.

4. An apparatus according to claim 3, wherein said crossbar extends over approximately the entire width of said casing.

5. An apparatus according to claim 3, wherein said crossbar is moveably disposed on said casing.

6. An apparatus according to claim 5, wherein said crossbar is connected to said casing via hinges.

7. An apparatus according to claim 1, wherein said drive means comprises a direct current motor, a gear, and a driving disk connected to said gear.

8. An apparatus according to claim 7, wherein said driving disk is disposed in said casing and is connected thereto.

9. An apparatus according to claim 1, wherein said support structure is hollow and accommodates power lines for said drive means.

10. An apparatus according to claim 1, which has a weight of less than 25 kg.

11. An apparatus according to claim 1, wherein said casing has a width of up to 2 meters.

12. An apparatus according to claim 1, wherein said casing is rotated at approximately 13 revolutions per minute.

* * * * *